US005232297A

United States Patent [19]

Kitazawa

[11] Patent Number: 5,232,297

[45] Date of Patent: Aug. 3, 1993

[54] PRINTING DEVICE WITH MARGIN SETTING FOR CUT TAPE

[75] Inventor: Yasunori Kitazawa, Anjo, Japan

[73] Assignee: Brother Kogyo Kabushiki Kaisha, Aichi, Japan

[21] Appl. No.: 949,793

[22] Filed: Sep. 22, 1992

[30] Foreign Application Priority Data

Sep. 26, 1991 [JP] Japan ..... 3-276861

[51] Int. Cl.[5] ..... B41J 11/26

[52] U.S. Cl. ..... 400/621; 400/208

[58] Field of Search ..... 400/621, 208, 120; 83/211; 346/24; 101/226

[56] References Cited

U.S. PATENT DOCUMENTS

| | | | |
|---|---|---|---|
| 4,525,088 | 6/1985 | Shipos et al. | 400/621 |
| 4,815,874 | 3/1989 | Richardson et al. | 400/208 |
| 4,927,278 | 5/1990 | Kuzuya et al. . | |
| 5,041,845 | 8/1991 | Ohkubo et al. | 400/120 |
| 5,066,152 | 11/1991 | Kuzuya et al. . | |
| 5,131,772 | 7/1992 | Yamaguchi | 83/211 |
| 5,174,670 | 12/1992 | Takaei et al. | 400/621 |
| 5,188,469 | 2/1993 | Nagao et al. | 400/208 |
| 5,188,470 | 2/1993 | Matsubara et al. | 400/621 |

FOREIGN PATENT DOCUMENTS 0429873 6/1991 European Pat. Off. .

*Primary Examiner*—Eugene H. Eickholt

*Attorney, Agent, or Firm*—Kane, Dalsimer, Sullivan, Kurucz, Levy, Eisele and Richard

[57] ABSTRACT

There is provided a printing apparatus for printing characters/symbols on a tape member. In the printing apparatus, a margin setting mode can be set. If the margin setting mode is set, the apparatus becomes operable in the margin setting mode in which the tape member is automatically cut with a predetermined margin remained ahead of the printed portion of the tape member. The apparatus includes feeding mechanism for feeding the tape member at a predetermined feeding speed, the feeding mechanism having a motor for generating a feeding force, the motor being neutrally actuated at a first rotational speed. Further, the apparatus is provided with a printing member for printing characters/symbols on the tape member, a cutting member disposed in a downstream side in the feeding direction of the tape member for cutting the tape member, and the rotational speed of the motor is changed from the first rotational speed to a second rotational speed which is slower than the first rotational speed when the margin setting mode is set.

13 Claims, 6 Drawing Sheets

PRINTING DEVICE WITH MARGIN SETTING FOR CUT TAPE

BACKGROUND OF THE INVENTION

The present invention relates to a printing device for printing characters/symbols on a tape-shaped recoding medium, and more specifically, to a printing device provided with a tape cut mechanism for cutting the tape-shaped recording medium.

The Applicant has disclosed such a printing device as described above in the European Patent Application EP 0429873A2, U.S. Pat. No. 4,927,278.

Further, conventionally, there has been known a printing device for printing characters/symbols on a tape-shaped recording medium provided with a tape cutting mechanism on the downstream side along the tap feed direction. The Applicant has disclosed such a tape cutting mechanism in the U.S. Pat. No. 5,066,152. In such a printing device, the printed tape-shaped recording medium is fed by a predetermined amount so that an appropriate rear margin is added, and then the tape-shaped recording medium is manually or automatically cut by the cutting mechanism. In such a printing device, however, it has been impossible to cut the tape to have a desired top margin, i.e., a blank portion ahead of the portion where the characters/symbols are printed. The top margin is to be set by cutting the tape with, for example, scissors.

In the tape print device provided with the tape cut mechanism, there has been desired that the tape-shaped recording medium is automatically cut so as to have a desired top margin.

In the meantime, it is preferable that a tape feed motor is driven at relatively high speed for high-speed printing operation. Generally, a pulse motor is used as the tape feed motor. In order for the pulse motor to be driven without step-out, the motor is applied with a pulse having a so-called self-start frequency when the motor starts rotating. Further, in order to drive the motor at relatively high speed, the motor is applied with a pulse having frequency greater than the self-start frequency. When the motor is driven by the pulse having the frequency greater than the self-start frequency, the following control becomes necessary:

(1) when the motor is stopped, the frequency of the pulse applied to the motor is gradually decreased (slow-down); and (2) when the motor starts rotating, pulse having the self-start frequency is applied to the motor, and thereafter, the frequency of the pulse is gradually increased (slow-up).

In order to cut the printed tape-shaped recording medium so as to have a top margin with the tape cutting mechanism, feeding and printing of the tape should be temporarily stopped during printing operation. In this case, however, the tape is fed without being printed and thus a printed character is divided due to the slow-down, i.e., a gradual decreasing of the rotational speed of the tape feed motor for ceasing thereof, and due to the slow-up, i.e., a gradual increasing of the rotational speed of the motor for restarting thereof. It should be noted that, during the slow-up and slow-down of the motor, a period for removing the thermal transfer ribbon from the recording medium becomes long relative to the case when the motor is normally rotated. Therefore, during the slow-up and slow-down of the motor, the temperature of the thermal head is lowered. With this condition, transferring of the ink form the thermal ribbon to the recording medium becomes incomplete, which loweres the quality of the printed characters/-symbols and the like. In order to avoid this problem, printing operation is inhibited during the slow-down and slow-up of the motor.

For avoiding the above described division of the printed characters/symbols, the tape feed motor must be driven at a relatively low speed. In this case, however, a problem arises in that since the tape feed motor is driven at the low speed, printing efficiency becomes greatly lowered even if the top margin is not required or a large number of characters/symbols are printed.

Therefore, it may contemplated that the tape feed motor is driven at relatively high speed, the motor and print processing are temporarily stopped when the tape is cut so as that a top margin is remained, and then, in order to prevent a printed character/symbol from being divided, the tape is fed in a reverse direction by a length corresponding to the amount caused by the slow-down and the slow-up of the motor after the tape has been cut. In this case, however, it is necessary to modify the print mechanism so that the tape can be reversely fed, thus a problem arises in that the print mechanism must be improved for this purpose, and as a result the print mechanism becomes complex.

SUMMARY OF THE INVENTION

It is therefore an object of the present invention to provide an improved printing device for printing characters/symbols on a tape-shaped recording medium without lowering the quality of printed characters/-symbols when the tape-shaped recording medium is cut so as to have a predetermined top margin.

For the above object, according to the present invention, there is provided a printing apparatus having means for printing image on a tape member, the apparatus comprising setting means for setting the apparatus to be operable in a margin setting mode in which the tape member is automatically cut with a predetermined margin being remained ahead of the printed portion of the tape member, feeding means for feeding the tape member, a cutting member disposed on the downstream side of the printing member in the feeding direction of the tape member for cutting the tape member, and controlling means for controlling the feeding means in such a fashion that the tape member being normally fed at a first feeding speed, while the tape member being fed at a second feeding speed which is slower than the first feeding speed when the margin setting mode is set.

DESCRIPTION OF THE ACCOMPANYING DRAWINGS

DESCRIPTION OF THE EMBODIMENTS

Figure 1:
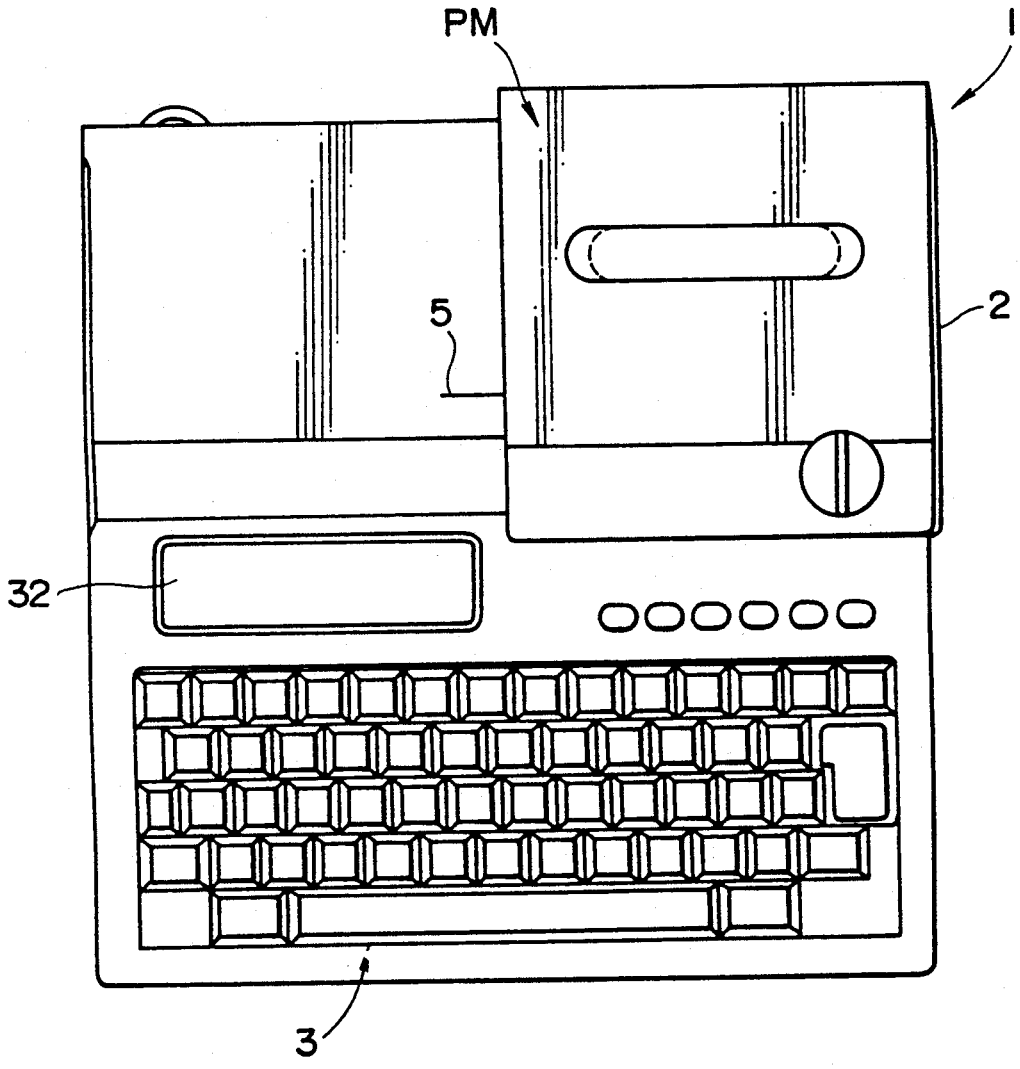
FIG. 1 is a plan view of a tape cut device.

FIG. 1 shows a plan view of a printing device 1 embodying a present invention. The printing device 1 comprises a keyboard 3 disposed on the front portion of the main body frame 2, a print mechanism PM disposed in the main body frame 2 behind the keyboard 3, and a liquid crystal display 32 capable of displaying characters and symbols disposed behind the keyboard 3.

The keyboard 3 includes character keys for inputting alphabet and other characters, numeral keys, symbol keys, a return key, a print key for performing a print processing, a type font selection key for selecting a font of characters, a tape feed key for feeding a tape 5 on which characters/symbols are printed, a power supply key for tuning ON and OFF a power supply, and the like. Further, the key board 3 includes a margin set key for setting a margin mode for cutting the tape 5 so as to have a predetermined top margin, and the like.

Figure 2:
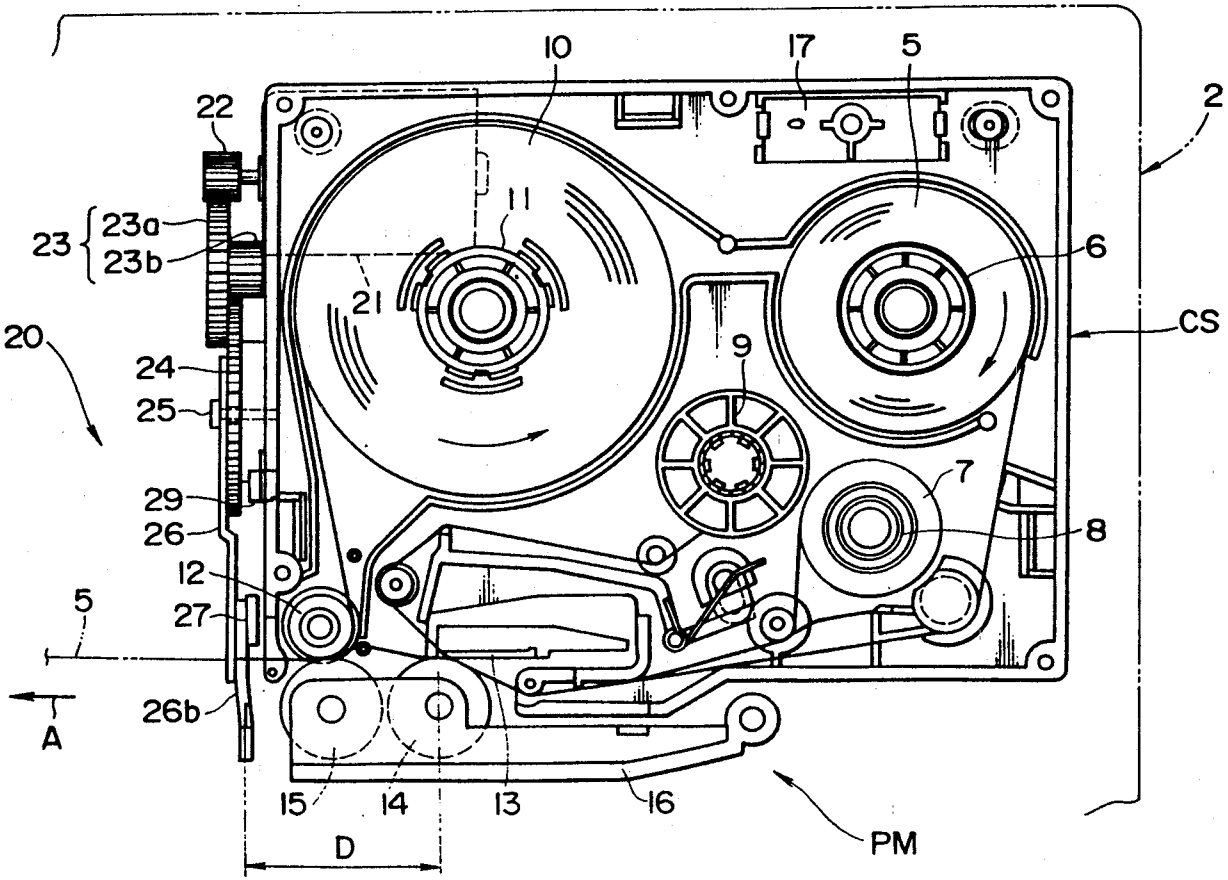
FIG. 2 is a schematic plan view of a print mechanism.

FIG. 2 is a schematic plan view of the print mechanism PM. To the print mechanism PM, a rectangular tape accommodation cassette CS is detachably coupled. The tape accommodation cassette CS accommodates a tape spool 6 around which a transparent film-type tape 5 having a width of about 24 mm is wound, a ribbon supply spool 8 around which an ink ribbon 7 is wound, a winding spool 9 for winding the used ink ribbon 7, a supply spool 11 around which a double-sided adhesive tape 10 having substantially the same width as that of the print tape 5 is wound with a releasable paper thereof provided on the outside thereof, and a joint roller 12 for adhering the print tape 5 and the double-sided adhesive tape 10. These spools and roller are rotatably arranged in the tape accommodation cassette CS.

A thermal head 13 is mounted on a machine frame 4 at the position where the print tape 5 and the ink ribbon 7 overlap. A platen roller 14 for pressing the print tape 5 and the ink ribbon 7 against the thermal head 13, and a feed roller for pressing the print tape 5 and the double-sided adhesive tape 10 against the joint roller 12 are rotatably supported by a support member 16. The thermal head 13 includes a heating element group composed of 128 heating elements which are disposed thereon in the direction parallel with the width direction of the print tape 5.

Therefore, when the heating element group is energized while the joint roller 12 and winding spool 9 are driven in a predetermined rotational direction in response to the rotation of a tape feed motor 34 (refer to FIG. 3) in a predetermined rotational direction, characters/symbols are printed on the print tape 5 by a plurality of dot rows. Moreover, the print tape 5 is fed in a tape feed direction indicated by arrow A with the double-sided adhesive tape 10 adhered. With respect to the further detail of the print mechanism PM, it is disclosed in Japanese Patent provisional Publication HEI 2-106555.

A cassette discrimination member 17 is mounted on the bottom surface of the above-described tape accommodation cassette CS to indicate a type of the tape accommodation cassette CS, i.e., to indicate a tape width of the print tape 5 accommodated therein. First and second sensors 30, 31 composed of a photo interrupter (refer to FIG. 4) are mounted on the main body frame 2 to sense a lug (not shown) provided with the cassette discrimination member 17.

Next, the tape cut mechanism 20 for cutting the print tape 5 to which characters have been printed will be described with reference to FIGS. 2 and 3.

A drive gear 22 is fixed to the drive shaft of a cutting motor 21 (a DC motor), and mounted on the machine frame 4. The drive gear 22 is meshed with a large diameter gear 23*a* of a first gear 23 rotatably supported by the machine frame 4. The small diameter gear 23*b* of the first gear 23 is meshed with a second gear 24 rotatably supported by the machine frame 4. A pin 25 fixed to the second gear 24 is engaged with a fork-shaped portion 26*a* of a swing lever 26. A movable blade 26*b* is integrally formed with the swing lever 26, while a fixed blade 27 is mounted on the machine frame 4 in the vicinity of the movable blade 26*b*.

Figure 3:
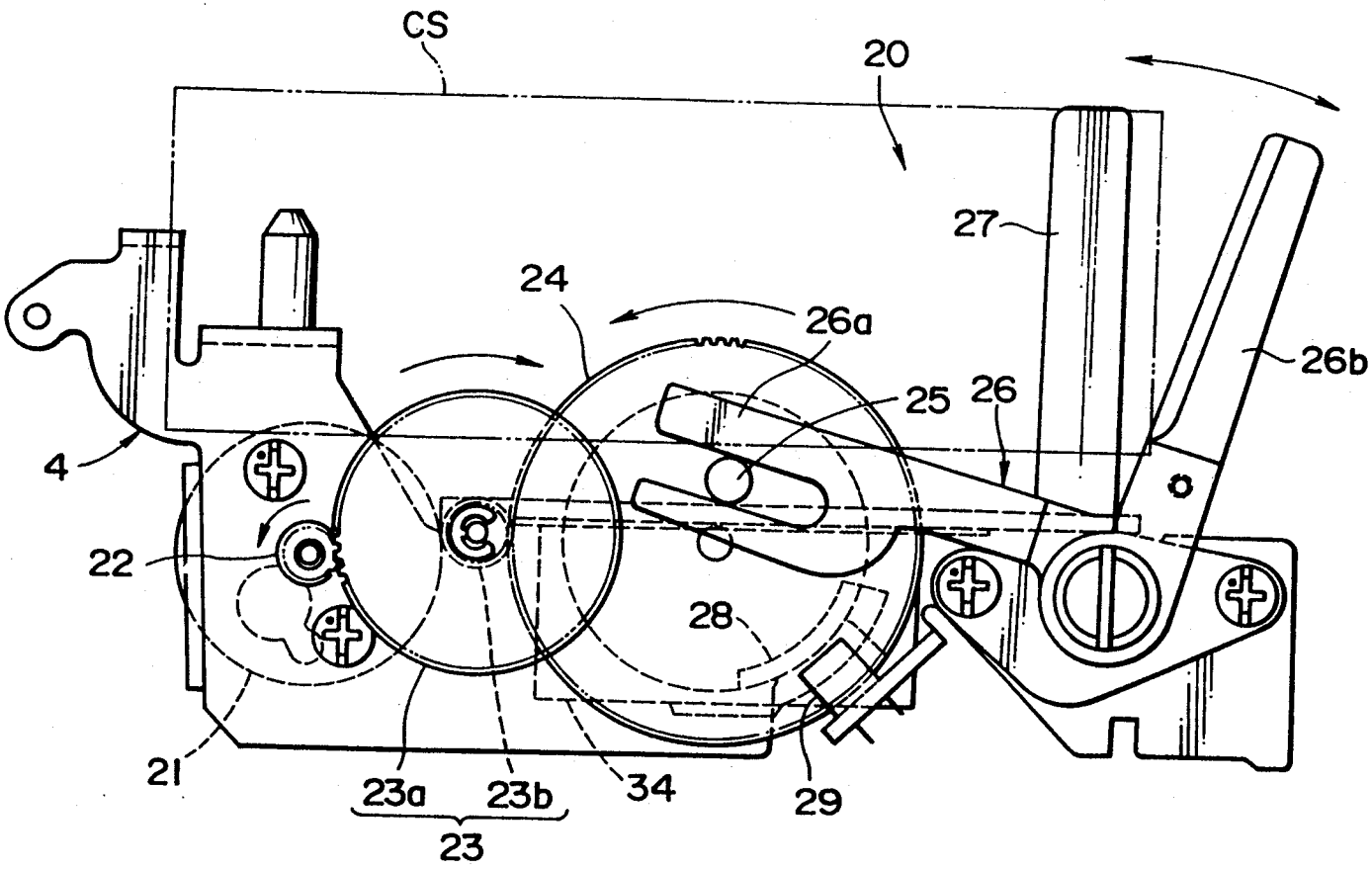
FIG. 3 is a schematic side view of the print mechanism showing a tape cut mechanism.

Consequently, when the cutting motor 21 is driven counterclockwise in FIG. 3, the second gear 24 is driven counterclockwise through the first gear 23. At the same time, the movable blade 26*b* is swung from a non-cutting position shown in FIG. 3 to a cutting position, and again from the cutting position to the non-cutting position by the swing motion of the swing lever 26 as indicated by arrow S. When the movable blade 26*b* is moved to the cutting-position, the print tape 5 is cut with cooperation of the movable blade 26*b* and the fixed blade 27. Note that the non-cutting position of the movable blade 26*b* corresponds to a reference position of the second gear 24 as shown in FIG. 2. The reference position of the second gear 24 is detected in such a manner that a thin shield plate 28 attached to the second gear 24 is sensed by a cutter sensor 29 composed of a photo interrupter.

Figure 4:
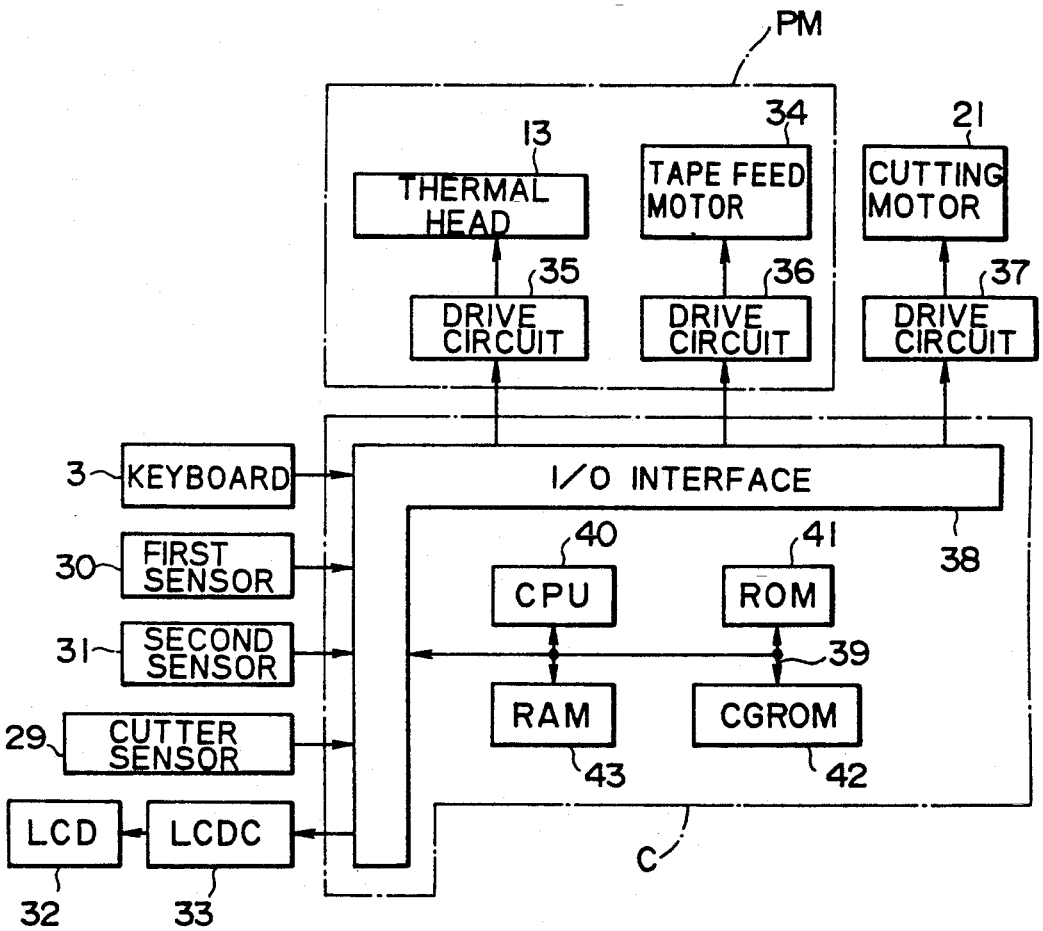
FIG. 4 is a block diagram of a control system of the tape print device.

FIG. 4 shows a block diagram showing a control system of the printing device according to the present invention.

The keyboard 3, first sensor 30, second sensor 31, cutter sensor 29, a display controller (LCDC) 33 including a display RAM for outputting display data to a liquid crystal display (LCD) 32, drive circuit 35 for driving the thermal head 13, drive circuit 36 for driving the tape feed motor 34, and drive circuit 37 for driving the cutting motor 21 are respectively connected to the I/O interface 38 of a control unit C.

The control unit C includes a CPU 40, the I/O interface 38 connected to the CPU 40 through a bus 39 such as a data bus, a ROM 41, a CGROM 42 and a RAM 43.

The ROM 41 as a program memory stores:

(1) a display control program for controlling the display controller 33 in correspondence with the code data of characters, numerals, symbols, and the like inputted through the keyboard 3;

(2) a control program for storing the code data in the document data memory of the RAM 43;

(3) an image development control program for developing dot patterns corresponding to respective code data in the document data memory to a print buffer;

(4) a drive control program for controlling the thermal head 13 and tape feed motor 34 by sequentially reading data in the print buffer; and (5) a control program for controlling printing processing which is a characteristic of the present invention.

Figure 6:
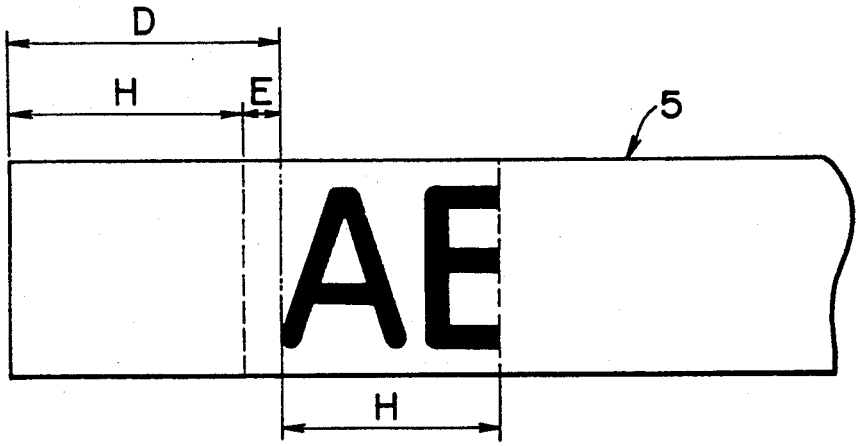
FIG. 6 is a plan view of a print tape explaining a cutting position when the tape is cut with a front blank space.

Further, as shown in FIGS. 2 and 6, the ROM 41 stores the number of drive pulses P in response to which the tape feed motor 34 is driven to feed the print tape 5.

In this case, the print tape 5 is fed by a tape length H obtained by subtracting the length of the top margin E from a distance D defined by the printing position of the thermal head 13 and the cutting position of the tape cutting mechanism 20. The ROM 41 further stores a print speed table shown in Table 1.

TABLE 1

| | High Speed | Low Speed |
|---|---|---|
| Drive Pulse Period | 4 msec | 30 msec |
| Imposing Period | 2 msec | 3 msec |

Note that the drive pulse period of "30 msec" corresponds to a frequency in a self-start region of the tape feed motor 34, i.e., a self-start frequency of the motor. Further, the imposing period is a period of time during which a drive voltage is supplied to the heating elements of the thermal head 13.

The CGROM 42 as a pattern data memory stores dot pattern data corresponding to each of a number of characters/symbols. The RAM 43 includes memories such as an input data memory, print buffer and the like, a buffer for temporarily storing the result of a calculation performed by the CPU 40, counter, pointer, flag memory and the like. Note that a margin setting mode flag YMF included in the flag memory is alternately set and reset upon depressing a mode set key.

Figure 5:
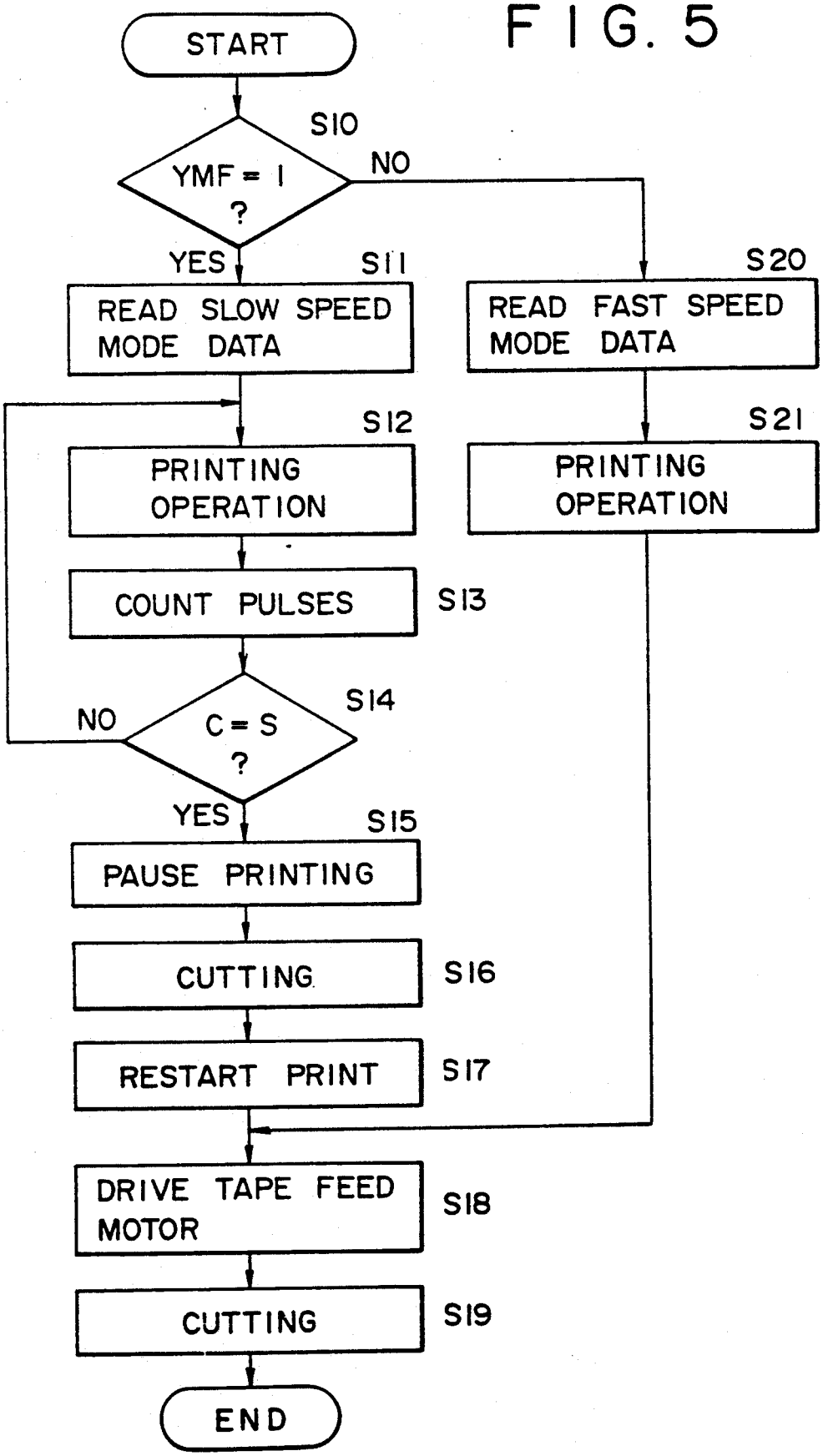
FIG. 5 is a schematic flowchart of routines for controlling the printing of a tape.
Figure 7:
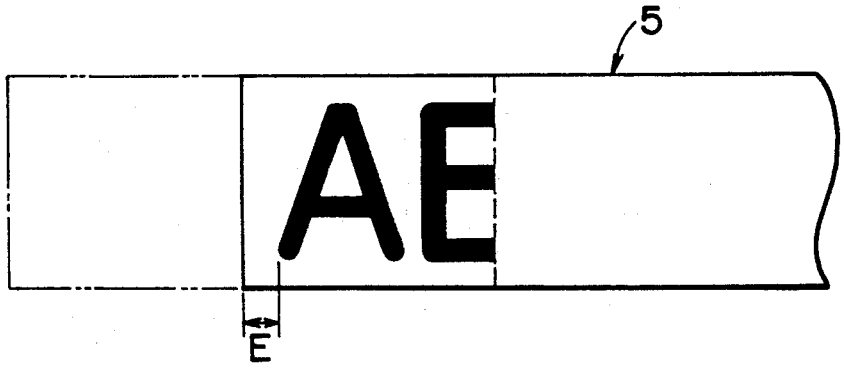
FIG. 7 is a diagram corresponding to FIG. 6 explaining the positional relationship between a cutting position cut with a front blank space and a print position.
Figure 8:
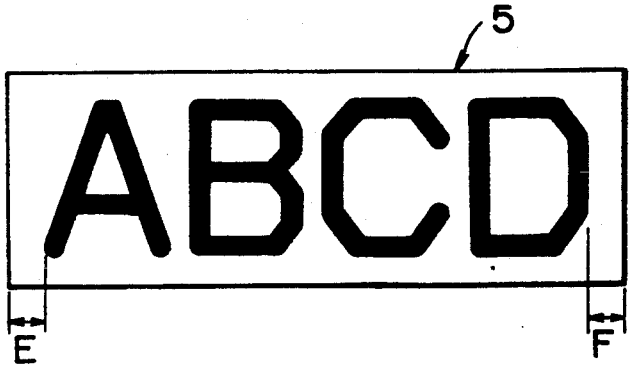
FIG. 8 is a plan view of a print tape on which characters have been printed and cut with a front blank space and rear blank space.

Next, a print control routine performed by the control unit C of the printing device 1 will be described based on a flowchart of FIG. 5 with reference to FIGS. 6 to 8. Assuming that the character codes of the characters, e.g., "ABCD" inputted through the keyboard 3 have already been stored in the document data memory.

When the print key on the keyboard 3 is depressed, this control is initiated. When the margin setting mode flag YMF is set and thus the margin setting mode is set (step S10: Yes), the low speed drive pulse period (30 msec) and low speed print period (3 msec) are read from the above print speed table (step S11). Thus, a print processing is executed with the tape feed motor 34 and the thermal head 13 being controlled in a low speed mode based on the drive pulse period of 30 msec and imposing period of 3 msec, respectively (step S12). Next, the number C of the drive pulses to be supplied to the tape feed motor 34 is counted (step S13). When the pulse number C is not equal to the drive pulse number P corresponding to the tape feed amount of H (step S14: No), the steps 12 to 14 are repeated. When the pulse number C is equal to the drive pulse number P, that is, when a position of the tape 5 to be cut, i.e., a position remaining the top margin E ahead of the printed portion is moved to the cutting position as shown by a broken lines in FIG. 6 (step S14: Yes), the thermal head 13 and the tape feed motor 34 are temporarily stopped so as to temporarily stop the print processing (step S15). Then, the cutting motor 21 is driven and the print tape 5 is cut at the cutting position as shown in FIG. 7 (step S16). Note, at this time the printing processing is temporarily stopped in the midway of printing the letter "B".

Thereafter, the printing process is restarted with the tape feed motor 34 and thermal head 13 controlled at the low speed in the same way as in step S12 (step S17). As shown in FIG. 8, when the print processing is restarted, the tape feed motor 34 and thermal head 13 are controlled at the low speed, and thus the print processing can be restarted without lowering the quality of printed characters, i.e., without the printed characters/symbols being divided. As shown in FIG. 8, upon completion of the print processing, the tape feed motor 34 is further driven in accordance with a predetermined pulse number corresponding to a tape feed amount obtained by adding the length of a rear margin F and the distance D between the thermal head 13 and the cutting position (step S18). Thereafter, the cutting motor 21 is driven again, and the print tape 5 is cut again (step S19). Therefore, as shown in FIG. 8, the print tape 5 on which the characters "ABCD" have been printed is cut twice so as to include the top margin E and the rear margin F. Note that in this embodiment, the top margin E and the rear margin F are set to the same length.

If the margin setting mode flag YMF is reset and the margin setting mode is not set when the print key is depressed (step S10: No), the high speed drive pulse period (4 msec) and high speed imposing period (2 msec) are read from the above print speed table (step S20). Thus, a print processing is executed with the tape feed motor 34 and the thermal head 13 being controlled at a high speed based on the drive pulse period of 4 msec and the imposing period of 2 msec, respectively (step S21). When the print processing is finished, the tape feed motor 34 is driven by a predetermined pulse number corresponding to a predetermined tape feed amount (step S18), the print tape 5 is cut (step S19) and the print processing is finished. Therefore, when the margin setting mode is not set, the print tape 5 on which the characters "ABCD" have been printed is cut only once at the position remaining the rear margin F.

As above, the feeding amount H is obtained in accordance with the following formulae.

(1) For the top margin $$H=D-E,$$

wherein D is distance between the printing position and the cutting position, and E is the length of the top margin.

(2) For the rear margin $$H=D+F,$$

wherein D is distance between the printing position and the cutting position, and F is the length of the rear margin.

As described above, when the margin setting mode is set, the thermal head 13 and tape feed motor 34 are controlled to be driven at the low speed, while when the margin setting mode is not set, the thermal head 13 and tape feed motor 34 are controlled to be driven at the high speed. As a result, even if the feeding of the tape is temporarily stopped in order to cut it with remaining the top margin E, the feeding of the tape is restarted such that the print processing can be continued without lowering the quality of printed characters. Further, when the top margin is not provided, the efficiency of a print processing can be greatly improved. In addition, any improvement is not required to the print mechanism PM and control unit C.

The above tape print control enables the amount of the top margin E and rear margin F to be arbitrarily set. Further, the tape feed motor 34 can be set to various low speeds capable of rapidly responding to a stop command and drive command. Furthermore, it is needless to say that the present invention can be applied to various tape print devices provided with various tape cut mechanisms.

In the above embodiment, the thermal transfer ribbon is used, and when heat is applied from the thermal head, ink on the thermal transfer ribbon is transferred onto the tape member. However, it is necessary to use the thermal transfer ribbon, but it is possible to use any method for forming images, characters, or symbols onto the tape member. For example, with using thermal sensitive paper as the tape member, characters/symbols can be formed by the heat of the thermal head without using the thermal transfer ribbon.

What is claimed is:

1. A printing apparatus having means for printing images on a tape member, said apparatus comprising:

setting means for setting said apparatus to be operable in a margin setting mode in which said tape member is automatically cut with a predetermined margin being remained ahead of the printed portion of said tape member;

feeding means for feeding said tape member;

a cutting member disposed on the downstream side of said printing member in the feeding direction of said tape member for cutting said tape member; and controlling means for controlling said feeding means in such a fashion that said tape member being normally fed at a first feeding speed, while said tape member being fed at a second feeding speed which is slower than said first feeding speed when said margin setting mode is set.

2. The printing apparatus according to claim 1, wherein when said margin setting mode has been set, the motor is temporarily stopped after said tape member has been fed by amount H since printing was started, the amount H being defined as:

$$H=D-E,$$

wherein D being the distance between the printing position and said cutting member, and E being the length of said predetermined margin, thereafter said tape member being cut by said cutting member, then the feeding operation being restarted.

3. The printing apparatus according to claim 1, wherein said feeding means further feeds said tape member by a predetermined amount when the printing operation has been finished in order to discharge the printed portion of said tape out of said printing apparatus.

4. The printing apparatus according to claim 3, wherein when the printing operation is finished, said tape member is fed by amount H which is defined as:

$$H=D+F,$$

wherein D is the distance between the printing position and said cutting member, and F is a predetermined length, thereafter said tape member is cut by said cutting member, whereby said tape member is cut with a margin having length F being remained behind the printed portion of said tape member.

5. The printing apparatus according to claim 1, which further comprises a detachably coupled cassette member for accommodating said tape member.

6. The printing apparatus according to claim 1, wherein said feeding means comprises a motor.

7. The printing apparatus according to claim 6, wherein said printing member comprises a thermal head, and wherein said feeding means feeds said tape member, and wherein said controlling means changes the period in which said thermal head is actuated in accordance with the change of the rotational speed of said motor.

8. The printing apparatus according to claim 7, wherein said period within which said thermal head is actuated is changed in such a fashion that the period when said tape member is fed at said second feeding speed is longer than the period when said tape member is fed at said first feeding speed.

9. The printing apparatus according to claim 8, wherein said printing apparatus utilizes a thermal transfer ribbon, and wherein said feeding means feeds said thermal transfer ribbon together with said tape member.

10. The printing apparatus according to claim 9, wherein said motor comprises a pulse motor, and wherein said second feeding speed is a speed at which said pulse motor is driven when pulse of a self-start frequency is applied to said pulse motor.

11. The printing apparatus according to claim 1, wherein said feeding means comprises a pulse motor, and said controlling means changes width of pulses to be applied to said pulse motor.

12. The printing apparatus according to claim 1, wherein said apparatus is operable in a normal mode in which said feeding means feeds said tape member at said first feeding speed without cutting said tape member to remain said predetermined margin ahead of the printed portion of said tape member.

13. The printing apparatus according to claim 1, wherein said image comprises characters/symbols.

* * * * *